United States Patent [19]

Blackshaw et al.

[11] Patent Number: 4,646,538

[45] Date of Patent: Mar. 3, 1987

[54] TRIPLE INTEGRATED HEAT PUMP SYSTEM

[75] Inventors: Andrew L. Blackshaw, Dunwoody; Glen P. Robinson, Jr., Atlanta, both of Ga.

[73] Assignee: Mississipi Power Co., Gulfport, Miss.

[21] Appl. No.: 827,733

[22] Filed: Feb. 10, 1986

[51] Int. Cl.[4] ..... F25B 27/00

[52] U.S. Cl. ..... 62/238.7; 62/238.6; 62/324.1

[58] Field of Search ..... 62/79, 238.6, 238.7, 62/324.1

[56] References Cited

U.S. PATENT DOCUMENTS

| | | | |
|---|---|---|---|
| 3,012,414 | 12/1961 | La Porte | 62/503 X |
| 3,232,073 | 2/1966 | Jobes et al. | 62/503 X |
| 3,246,482 | 4/1966 | Harnish | 62/503 X |
| 4,030,315 | 6/1977 | Harnish | 62/503 X |
| 4,194,367 | 3/1980 | Lavik | 62/503 X |

*Primary Examiner*—Lloyd L. King

*Attorney, Agent, or Firm*—B. J. Powell

[57] ABSTRACT

A heat pump system with three heat exchangers, two of which are connected through a reversible expander and the third of which is connected to both of the first mentioned exchangers through an expander and check valve arrangement for refrigerant to flow from the third to either of the first two heat exchangers but not vice versa. A flow control valve selectively connects the other side of either of the first two heat exchangers to the suction side of the compressor while selectively connecting the other side of any one of the heat exchangers to the high pressure side of the compressor to form a refrigeration loop including two of the heat exchangers. Refrigerant flow through the heat exchanger not being used is blocked.

18 Claims, 6 Drawing Figures

TRIPLE INTEGRATED HEAT PUMP SYSTEM

BACKGROUND OF THE INVENTION

This invention relates generally to heat pump systems and more particularly to a heat pump system for space heating and cooling as well as potable water heating.

Various heat pump systems have been proposed which not only have the capability of space heating and cooling but also have the capability of heating potable water. Many such systems simply use the condenser or a desuperheater to obtain the heat input for potable water heating. Such systems typically only heat the potable water when the heat pump system is operating for space heating or cooling. Other systems have been proposed in which the heat pump only serves to heat potable water and is not concerned with space heating or cooling. More recently, attempts have been made to combine these two types of systems to produce an integrated heating and cooling system with the capability of heating potable water.

These prior art attempts to produce an integrated system have resulted in an excessive number of control valves and other components. Also, these prior art systems usually have had certain limitations built therein as to how such systems could be used so that the flexibility of the system is limited. Further, these prior art systems frequently pumped refrigerant through coils not being used in the particular operating mode thereby increasing pumping pressure requirements, heat loss, and therefore operational and maintenance costs.

SUMMARY OF THE INVENTION

These and other problems and disadvantages associated with the prior art are overcome by the invention disclosed herein by providing a heat pump system which has the capability of both space heating and cooling as well as potable water heating and which uses the minimum number of components while at the same time permitting any two heat exchangers in the system to be used without involving the other heat exchanger so that any heat exchanger not being used in a particular mode can be bypassed. Further, those portions of the system not being utilized in any mode remain connected to the suction side of the compressor to depressurize that portion of the system. Liquid traps prevent the undesired build-up of refrigerant in that portion of the system not being currently used. The system design permits the various operational modes by using only one additional externally controlled valve over that associated with a heat pump system used only to space heat and cool with the rest of the additional components used to interconnect the system being operated without any external control force.

The apparatus of the invention includes a refrigerant pressurizing means whose high pressure outlet is connected to the input of a three-way valve. One output of the threeway valve is connected to the common input of a four-way valve. The common output of the four-way valve is connected to the suction side of the refrigerant pressurizing means.

One of the reversible outlet ports on the four-way valve is connected to a space heat exchanger while the other reversible outlet port on the four-way valve is connected to a source heat exchanger. The opposite sides of the space and source heat exchangers are connected to each other through a reversible expansion device.

The other output of the three-way valve is connected to an alternate heat exchanger. The other side of the alternate heat exchanger is connected to an alternate expansion device. The other side of the alternate expansion device is connected to the common point between the reversible expansion device and the space heat exchanger through a check valve allowing refrigerant to flow from the alternate heat exchanger to the space heat exchanger through a check valve. The other side of the alternate expansion device is also connected to the common point between the reversible expansion device and the source heat exchanger so that refrigerant can flow from the alternate heat exchanger to the source heat exchanger through a check valve.

This configuration allows four separate modes of operation: space heating only, space cooling only, space cooling with water heating, and water heating only. At all times, those portions of the circuit not being used remain connected to the suction side of the pressurizing means so as to maintain minimum pressure therein. This construction has a minimum number of components that require an external power source or control source to operate. The only additional externally controlled component added to this circuit over a conventional heat pump circuit is the three-way valve. At the same time, any two of the heat exchangers may be used without the refrigerant having passed through the other heat exchanger thereby permitting pumping and heat loss forces to be minimized.

These and other features and advantages of the invention will become more clearly understood upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
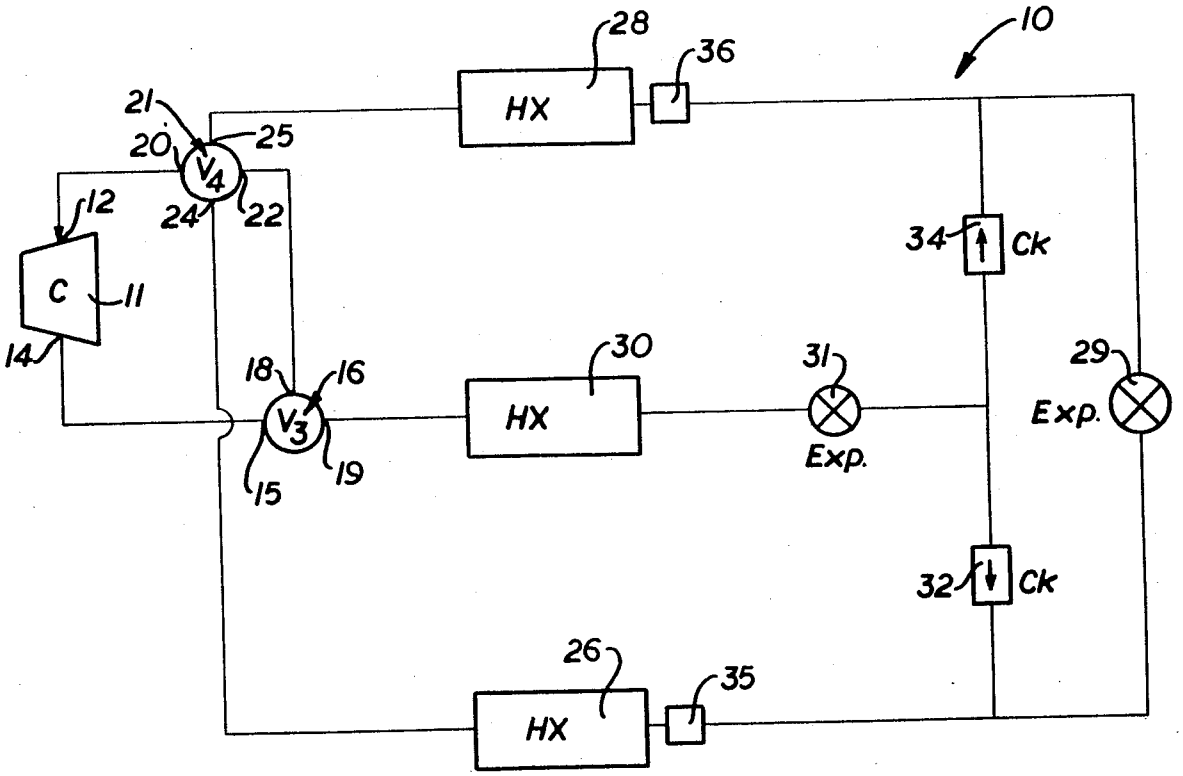
FIG. 1 is a schematic diagram conceptionally illustrating the invention.

FIG. 1 is a schematic diagram conceptionally illustrating the heat pump system 10 of the invention. The heat pump system has the capability of interconnecting three different heat exchangers so that any of the three heat exchangers can have a heating output and also where two of the three heat exchangers can have a cooling output as will become more apparent.

The heat pump system 10 includes a refrigerant pressurizing device 11 capable of pressurizing the refrigerant from the lower operating pressure to the higher operating pressure of the system. The most common such pressurizing device 11 is an electrically driven compressor. The pressurizing device 11 has a suction inlet 12 and a pressure outlet 14.

The pressure outlet 14 is connected to the inlet port 15 of a three-way valve 16 which may be solenoids pneumatically, mechanically or otherwise operated. The three-way valve 16 has first and second outlet ports 18 and 19 respectively which can be selectively and alternatively connected to the inlet port 15 depending on the position of the valve.

The suction inlet 12 on the pressurizing device 11 is connected to the common outlet port 20 on a four-way valve 21 which may be solenoids pneumatically, mechanically or otherwise operated. The common inlet port 22 on valve 21 is connected to the outlet port 18 on the three-way valve 16. It will be seen that the four-way valve 21 is equipped with reversing ports 24 and 25 which can be selectively and alternatively connected to the common inlet port 22 or the common outlet port 20 depending on the position of the valve.

The reversing port 24 on the valve 21 is connected to one side of a space heat exchanger 26. The reversing port 25 on the valve 21 is connected to one side of a source heat exchanger 28. The other side of the space and source heat exchangers 26 and 28 are connected together through a reversible expansion device 29 of well known construction.

The second outlet port 19 on the three-way valve 16 is connected to one side of an alternate heat exchanger 30 with the other side of the heat exchanger 30 being connected to an alternate expansion device 31. The other side of the alternate expansion device 31 is connected to the common point between the space heat exchanger 26 and the reversible expansion device 29 through a first check valve 32 so that refrigerant can flow from the expansion device 31 into the space heat exchanger 26 while refrigerant flow in the opposite direction is precluded. The alternate expansion device 31 is also connected to the common point between the source heat exchanger 28 and the reversible expansion device 29 through a second check valve 34 which allows refrigerant to flow from the alternate expansion device 31 to the source heat exchanger 28 but which precludes refrigerant flow in the opposite direction.

Liquid traps 35 and 36 respectively are placed in the refrigerant lines between the heat exchangers 25 and 26 and the reversible expansion device 29. These traps are located adjacent the heat exchangers to prevent a build up of liquid refrigerant in either of the heat exchangers 26 or 28 when it is not being used.

It will be appreciated that the heat exchangers 26, 28 and 30 may be of any desired type such as refrigerant-to-liquid exchangers of refrigerant-to-air exchangers as well as any variation thereof. Commonly, the alternate heat exchanger 30 is a refrigerant-to-liquid type while the space heat exchanger 26 is of the refrigerant-to-air type. The source heat exchanger 28 may be of either type depending on the source of heat or cooling to the heat exchanger. Where the source heat exchanger 28 is located outside, it is typically a refrigerant-to-air type, however, if a liquid such as water is being used as the heat source and sink, then a refrigerant-to-liquid heat exchanger would be used. It will be appreciated that the particular type heat exchanger being used has no effect on the invention.

The invention as configured in FIG. 1 has the capability of having a heating or cooling output from the heat exchangers 26 and 28 while being able to have only a heating output of the heat exchanger 30. For sake of description, the space heat exchanger 26 will be assumed to be in the space to be conditioned while the source heat exchanger 28 will be connected to the heat source and sink. The alternate heat exchanger 30 will be assumed to be connected to a potable water source for heating the potable water. It will further be appreciated that these assumptions are not meant to be limiting since any three heat exchangers will operate from this system.

The liquid traps 35 and 36 are illustrated simply as inverted U-shaped lengths of tubing placed in the system which has a maximum elevation as high as the pressure head to which the trap is exposed when the associated heat exchanger is blocked. Typically, this elevation is the elevation of the highest heat exchanger component of the system. It will be appreciated that other types of liquid traps may be used in lieu of the tubing loops provided. Such devices permit gas to flow therethrough but block the flow of liquid therethrough.

OPERATION

To show the various modes of operation, FIGS. 2–5 show the refrigerant flow paths around the circuit in each mode in heavy lines while those portions of the circuit not being used in that mode are shown in thinner lines.

Figure 2:
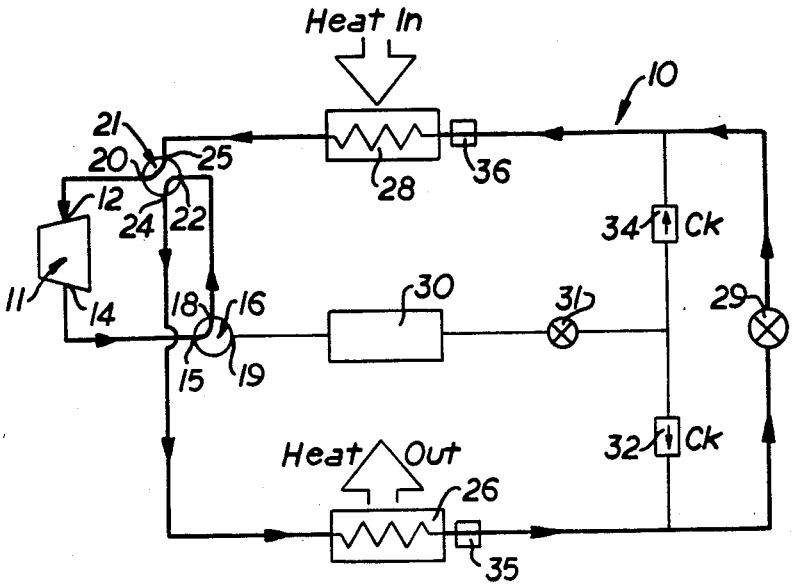
FIG. 2 is a schematic diagram similar to FIG. 1 showing the "space heating only" mode of operation.

FIG. 2 illustrates the heat pump system 10 in a "space heating only" mode in which heat is produced out of the space heat exchanger 26 while heat is taken in by the source heat exchanger 28. In this mode, it will be seen that the three-way valve 16 is set so that the inlet port 15 is connected to the outlet port 18 while the outlet port 19 is blocked. The four-way valve 21 is set so that the inlet port 22 is connected to the reversible port 24 while the common outlet port 20 is connected to the reversible port 25.

The refrigerant flows from the high pressure outlet 14 in pressurizing device 11 through the three-way valve 16 and the four-way valve 21 to the space heat exchanger 26 so that the heat in the refrigerant is rejected into the space to condense the refrigerant (i.e., the heat exchanger 26 is acting as the condenser). The liquid refrigerant is then forced through the liquid trap 35 and through the reversible expansion device 29 to expand the liquid refrigerant down to evaporator pressure. The low pressure liquid refrigerant then flows to the source heat exchanger 28 where the heat is adsorbed in the refrigerant to vaporize the refrigerant (i.e., heat exchanger 28 is acting as the evaporator). The vaporized refrigerant then passes back to the suction inlet 12 of the pressurizing device 11 through the four-way valve 21. Thus, it will be seen that the heat rejected from the space heat exchanger 26 can be used to heat any conditioned space while the heat input to the source heat exchanger 28 may be from any particular source.

It will be appreciated that in the "space heating only" mode, the refrigerant does not flow through the alternate heat exchanger 30 nor the alternate expansion device 31. To prevent any refrigerant being trapped in that portion of the system as it condenses, it will be seen that the check valve 32 connects this portion of the circuit to the low pressure side of the reversible expansion device 29 so that any high pressure refrigerant can flow from the alternate heat exchanger 30 through the alternate expansion device 31 and the check valve 32 into the low pressure line going to the source heat exchanger 28. On the other hand, the high pressure liquid refrigerant passing out of the space heat exchanger 26 is blocked from the alternate heat exchanger 30 and the alternate expansion device 31 by the check valve 34. Likewise, check valve 32 prevents any drainage of the low pressure liquid refrigerant out of the reversible heat exchanger 29 back into the alternate heat exchanger 30 so as not to starve the operating portions of the circuit of refrigerant.

Figure 3:
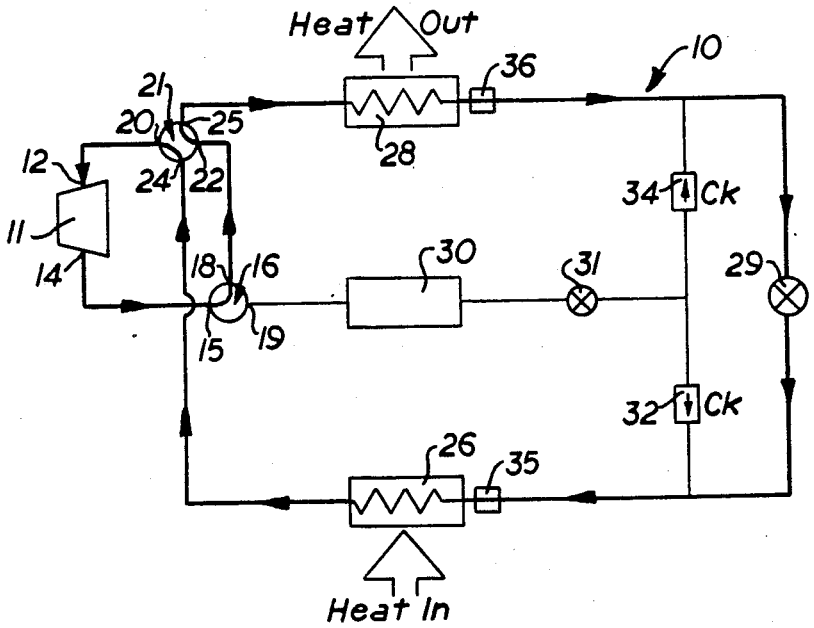
FIG. 3 is a schematic diagram similar to FIG. 1 showing the "space cooling only" mode of operation.

FIG. 3 illustrates the heat pump system 10 in a configuration for the "space cooling only" mode. The four-way valve 21 is set so that the inlet port 22 is connected to the reversible port 25 while the common outlet port 20 is connected to the reversible port 24. The three-way valve 16 remains set so that the inlet port 15 is connected to the first outlet port 18. It will be seen that refrigerant flow in this mode is simply the reverse of the refrigerant flow in the mode seen in FIG. 2. Thus, the four-way valve 21 serves simply as a reversing valve to reverse the flow around the circuit as is typical in any heat pump circuit. The source heat exchanger 28 now becomes the condenser while the space heat exchanger 26 becomes the evaporator so that the source heat exchanger 28 rejects heat and the space heat exchanger 26 cools the conditioned space. Since the reversible expansion device 29 has the capability of expanding the refrigerant in both flow directions, the refrigerant flow through the device is simply reversed from that shown in FIG. 2.

It will be appreciated that in the "space cooling only" mode, the refrigerant still does not flow through the alternate heat exchanger 30 nor the alternate expansion device 31. The check valve 34 connects this portion of the circuit to the low pressure side of the expansion device 29 so that any high pressure refrigerant can flow from the alternate heat exchanger 30 through the alternate expansion device 31 and the check valve 34 into the low pressure line going to the space heat exchanger 26. The high pressure refrigerant passing out of the source heat exchanger 28 is blocked from the alternate heat exchanger 30 and the alternate expansion device 31 by the check valve 32 with check valve 34 now serving as a liquid trap to prevent accumulation of low pressure liquid refrigerant in the heat exchanger 30.

Figure 4:
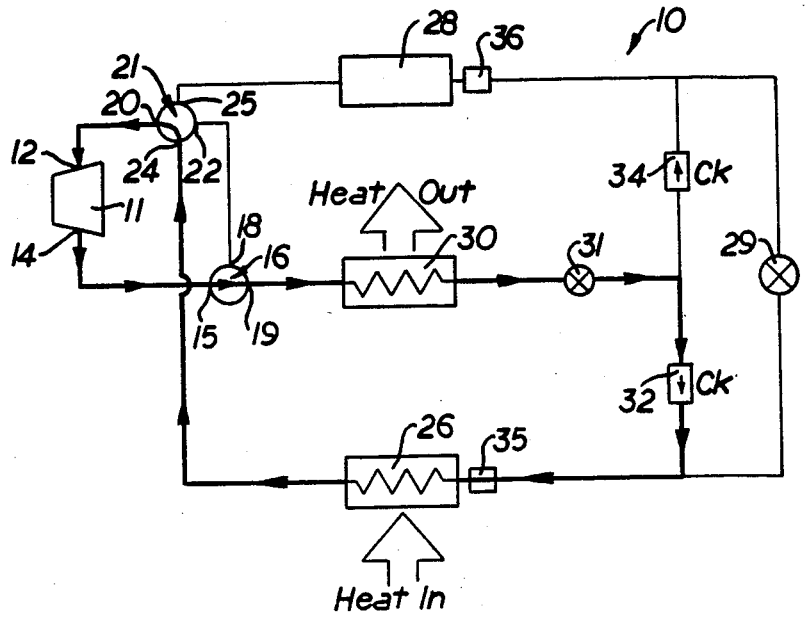
FIG. 4 is a schematic diagram similar to FIG. 1 showing the "space cooling and water heating" mode of operation.

FIG. 4 illustrates the heat pump system 10 in the "space cooling and water heating" mode where heat is rejected by the alternate heat exchanger 30 while heat is adsorbed in the space heat exchanger 26. In this mode, the three-way valve 16 is set so that the inlet port 15 is connected to the outlet port 19 while the four-way valve 21 is set so that the reversible port 24 is connected to the common outlet port 20.

The refrigerant now flows from the high pressure outlet 14 on the refrigerant pressurizing device 11 through the three-way valve 16 to the alternate heat exchanger 30 so that heat is rejected from the refrigerant to condense same (i.e., alternate heat exchanger 30 is now the condenser). The refrigerant then flows through the alternate expansion device to expand the refrigerant down to evaporator pressure and then through the check valve 32 to the space heat exchanger 26. Heat from the space is adsorbed in the refrigerant in the space heat exchanger 26 before it flows back to the suction inlet 12 on the pressurizing device 11 through the four-way valve 21.

It will be appreciated that, during this time, the four-way valve 21 is set so that the reversing port 25 is connected to the inlet port 22. However, the first outlet port 18 on the three-way valve is blocked so that the refrigerant flowing out of the alternate expansion device 31 does not flow to the source heat exchanger 28. On the other hand, the reversible expansion device 29 permits any high pressure in the source heat exchanger 28 to be bled off therethrough back into the suction side of the refrigerant pressurizing device 11.

The liquid trap 36 associated with the source heat exchanger 28 serves to prevent the flow of low pressure liquid refrigerant into the source heat exchanger 28 while it is not being used in the "space cooling and water heating" mode of FIG. 4. This insures that excess liquid refrigerant does not accumulate in the source heat exchanger 28 and starve the operating portion of the system for refrigerant.

Figure 5:
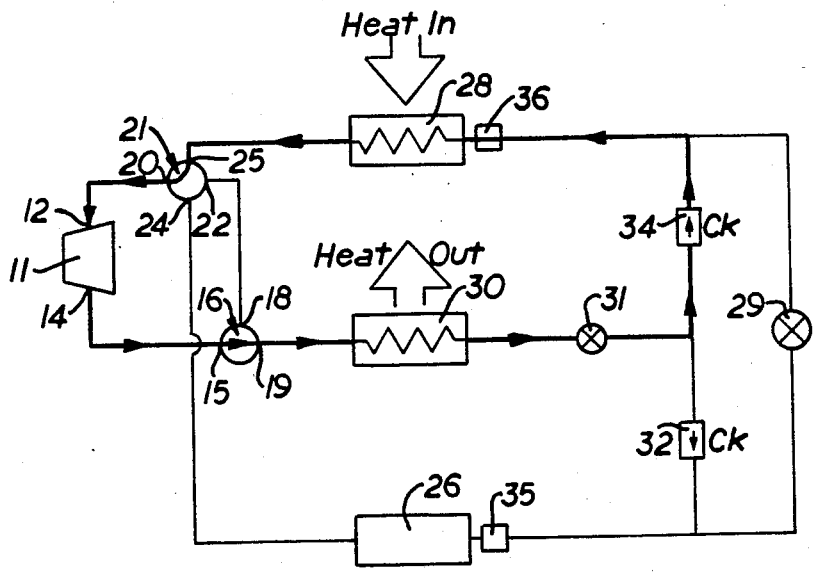
FIG. 5 is a schematic diagram similar to FIG. 1 showing the "water heating only" mode of operation.

FIG. 5 illustrates the heat pump system 10 in the "water heating only" mode. The three-way valve 16 is set so that the inlet port 15 communicates with the outlet port 19 while the four-way valve 21 is set so that the reversible port 25 is connected to the common outlet port 20.

The refrigerant from the high pressure outlet 14 of the refrigerant pressurizing device 11 passes through the three-way valve 16 into the alternate heat exchanger 30 so that the refrigerant heat is rejected therefrom while the refrigerant is condensed (i.e., exchanger 30 is the condenser). The refrigerant then flows through the alternate expansion device 31 where it is expanded down to evaporator pressure and flows through the check valve 34 to the source heat exchanger 28 so that heat is adsorbed in the refrigerant to vaporize same. The vaporized refrigerant then flows back to the suction inlet 12 on the pressurizing device 11.

It will be appreciated that the outlet port 18 in the three-way valve 16 is blocked so that the refrigerant cannot flow back through the space heat exchanger 26 through valve 32. At the same time, any pressure above evaporator pressure in the space heat exchanger 26 can bleed back into the source heat exchanger 28 through the reversible expansion device 29.

The liquid trap 35 associated with the space heat exchanger 26 prevents the flow of low pressure liquid refrigerant into the space heat exchanger 26 while the heat pump system 10 is in the "water heating only" mode as seen in FIG. 5. Again, this prevents the accumulation of low pressure liquid refrigerant within the space heat exchanger 26 to starve the operating portion of the system.

TYPICAL INSTALLATION

Figure 6:
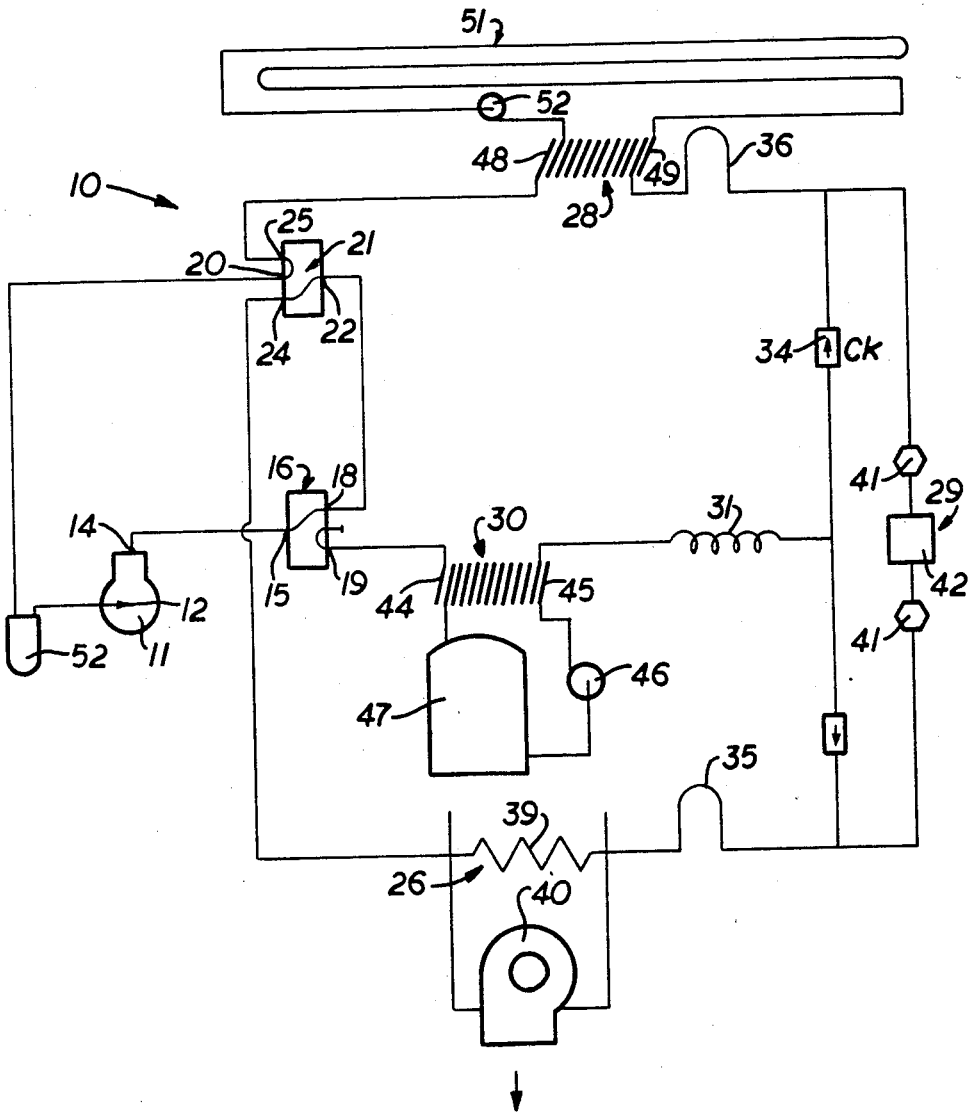
FIG. 6 is a schematic diagram of a system incorporating the invention as schematically illustrated in FIGS. 1–5.

FIG. 6 is a schematic of the heat pump system 10 in a typical application where the alternate heat exchanger 30 is used to heat a potable water supply, where the space heat exchanger 26 is used to condition air in a desired space and where the source heat exchanger 28 is used to accept and reject heat to a ground water source. The valves 16 and 21 are illustrated schematically different but are the same valves as in FIGS. 1–5. The space heat exchanger 26 is illustrated as a refrigerant-to-air coil 39 with an appropriate air blower 40 to blow air across the coil 39. The reversible expansion device 29 is illustrated as a pair of typical expanders 41 so that one expander works to expand the refrigerant from condenser pressure down to evaporator pressure in one direction and the other expander 41 does the same in the opposite direction with a bidirectional filter-dryer 42 therebetween. It will likewise be appreciated that any number of reversible expansion devices 29 may be used.

The alternate heat exchanger 30 is illustrated as a refrigerant-to-liquid double wound tube heat exchanger such as that disclosed in U.S. Pat. No. 4,316,502 with a refrigerant coil 44 and a liquid coil 45 wound together. Exchanger 30 may also be a shell and tube type exchanger. Thus, the heat exchanger 30 places the water coil 45 in a heat exchange relationship with the refrigerant flowing through the refrigerant coil 44. The water coil 45 is connected to a convenient hot water tank 47 through a potable pump 46 to pump the water from the tank through the water coil 45 to be heated and then back to the tank. The alternate expansion device 31 is illustrated as a capillary tube sized to expand the liquid refrigerant from condenser pressure down to evaporator pressure at the proper rate for the system operating pressures and temperature.

The source heat exchanger 28 is also illustrated as a double wound tube refrigerant-to-liquid heat exchanger with a refrigerant coil 48 and liquid coil 49 connected to a convenient liquid source. A ground loop pump 50 usually forces the liquid from the ground loop 51 through the liquid coil 49. The heat transfer liquid in this loop may be any heat transfer liquid such as a refrigerant which has a large ground embedded loop to transfer the heat into or out of the refrigerant or may be ground water. The refrigerant is returned to the suction side of the compressor 11 through a conventional suction accumulator 52.

It will be appreciated that this invention is applicable to any multiple heat exchanger refrigeration circuit using a vapor compression cycle. For instance, a refrigeration circuit used only for space cooling and in which the refrigerant flow is not reversed for space heating would benefit from the invention.

We claim:

1. A heat pump system comprising:

a first heat exchange means having first and second refrigerant connections;

a second heat exchange means having first and second refrigerant connections;

a third heat exchange means having first and second refrigerant connections;

a refrigerant pressurizing device having a suction inlet and a high pressure outlet;

a reversible refrigerant expansion means for expanding refrigerant from condenser to evaporator pressure connected between the second refrigerant connections on said first and second heat exchange means;

an alternate refrigerant expansion means for expanding refrigerant from condenser to evaporator pressure connected to the second refrigerant connection on said third heat exchange means;

check valve means connecting said alternate refrigerant expansion means to the common points between said reversible expansion means and each of said first and second heat exchange means so that refrigerant can flow from said alternate expansion means to said first and second heat exchange means but flow of refrigerant from said first and second heat exchange means is prevented;

control valve means for selectively:

(a) connecting the first connection on said first heat exchange means to the suction inlet on said pressurizing device while connecting the high pressure outlet on said pressurizing device to the first connection on said second heat exchange means and while blocking the first connection on said third heat exchange means against refrigerant flow therethrough;

(b) connecting the first connection on said second heat exchange means to the suction inlet on said pressurizing device while connecting the high pressure outlet on said pressurizing device to the first connection on said first heat exchange means and while blocking the first connection on said third heat exchange means against refrigerant flow therethrough; and, (c) connecting the first connection on said first heat exchange means to the suction inlet on said pressurizing device while connecting the high pressure outlet on said pressurizing device to the first connection on said third heat exchange means and while blocking the first connection on said second heat exchange means against refrigerant flow therethrough.

2. The heat pump system of claim 1 wherein said control valve means further selectively connects the first connection on said second heat exchange means to the suction inlet on said pressurizing device while connecting the high pressure outlet on said pressurizing device to the first connection on said third heat exchange means and while blocking the first connection on said first heat exchange means against refrigerant flow therethrough.

3. The heat pump system of claim 1 wherein said control valve means includes a first valve alternatively connecting the first connections on said first and second heat exchange means to the suction inlet on said pressurizing device.

4. The heat pump means of claim 3 wherein said control valve means includes a second valve for selectively connecting the high pressure refrigerant outlet on said pressurizing means to the first connection on said third heat exchange means.

5. The heat pump means of claim 3 wherein said first valve includes a common outlet port connected to the suction inlet on said pressurizing device, a common inlet port, a first reversible port connected to the first connection on said first heat exchange means, a second reversible port connected to the first connection on said second heat exchange means and control means for selectively connecting said common outlet port while connecting said common inlet with said second reversible port and alternatively connecting said common outlet port with said second reversible port while connecting said common inlet with said first reversible port.

6. The heat pump means of claim 5 wherein said second valve selectively connects the high pressure refrigerant outlet on said pressurizing device to said common inlet to said first valve and alternatively connects the high pressure refrigerant outlet on said pressurizing device to the first connection on said third heat exchange means.

7. The heat pump means of claim 5 wherein said second valve includes an inlet port connected to said high pressure outlet on said pressurizing device, a first outlet port connected to said common inlet port on said first valve, a second outlet port connected to the first connection on said third heat exchange means, and control means for selectively connecting said inlet port to said first outlet port while blocking said second outlet port and alternatively connecting said inlet port to said second outlet port while blocking said first outlet port.

8. The heat pump means of claim 2 wherein said control valve means includes a first valve having a common outlet port connected to the suction inlet on said pressurizing device, a common inlet port, a first reversible port connected to the first connection on said first heat exchange means, a second reversible port connected to the first connection on said second heat exchange means and including control means for selectively connecting said common outlet port with said first reversible port while connecting said common inlet with said second reversible port and alternatively connecting said common outlet port with said second reversible port while connecting said common inlet with said first reversible port.

9. The heat pump means of claim 8 wherein said control valve means further includes a second valve having an inlet port connected to said high pressure outlet on said pressurizing device, a first outlet port connected to said common inlet port on said first valve, a second outlet port connected to the first connection on said third heat exchange means, and including control means for selectively connecting said inlet port to said first outlet port while blocking said second outlet port and alternatively connecting said inlet port to said second outlet port while blocking said first outlet port.

10. The heat pump means of claim 1 further including first liquid trap means interposed between said first heat exchange means and said alternate refrigerant expansion means, said first liquid trap means preventing the flow of liquid refrigerant from said alternate refrigerant expansion means into said first heat exchange means associated therewith while the first connection on said first heat exchange means is blocked against refrigerant flow therethrough.

11. The heat pump system of claim 2 further including second liquid trap means interposed between said second heat exchange means and said alternate expansion means, said second liquid trap means preventing the flow of liquid refrigerant from said alternate refrigerant expansion means into said second heat exchange means associated therewith while the first connection on said second heat exchange means is blocked against refrigerant flow therethrough.

12. The heat pump means of claim 11 further including first liquid trap means interposed between said first heat exchange means and said alternate refrigerant expansion means, said first liquid trap means preventing the flow of liquid refrigerant from said alternate refrigerant expansion means into said first heat exchange means associated therewith while the first connection on said first heat exchange means is blocked against refrigerant flow therethrough.

13. The heat pump system of claim 7 further including second liquid trap means interposed between said second heat exchange means and said alternate refrigerant expansion means, said second liquid trap means preventing the flow of liquid refrigerant from said alternate refrigerant expansion means into said second heat exchange means associated therewith while the second connection on said second heat exchange means is blocked against refrigerant flow therethrough.

14. The heat pump means of claim 13 further including first liquid trap means interposed between said first heat exchange means and said alternate refrigerant expansion means, said first liquid trap means preventing the flow of liquid refrigerant from said alternate refrigerant expansion means into said first heat exchange means associated therewith while the first connection on said first heat exchange means is blocked against refrigerant flow therethrough.

15. The heat pump system of claim 9 further including second liquid trap means interposed between said second heat exchange means and said alternate refrigerant expansion means, said second liquid trap means preventing the flow of liquid refrigerant from said alternate refrigerant expansion means into said second heat exchange means associated therewith while the second connection on said second heat exchange means is blocked against refrigerant flow therethrough.

16. The heat pump system of claim 15 further including first liquid trap means interposed between said first heat exchange means and said alternate refrigerant expansion means, said first liquid trap means preventing the flow of liquid refrigerant from said alternate refrigerant expansion means into said first heat exchange means associated therewith while the first connection on said first heat exchange means is blocked against refrigerant flow therethrough.

17. The heat pump system of claim 1 wherein said check valve means includes a first check valve connecting said alternate refrigerant expansion means to the common point between said reversible refrigerant expansion means and the second connection on said first heat exchange means; and a second check valve connecting said alternate refrigerant expansion means to the common point between said reversible refrigerant expansion means and the second connection on said second heat exchange means.

18. A refrigeration circuit comprising:

a first heat exchange means having first and second refrigerant connections;

a second heat exchange means having first and second refrigerant connections;

a third heat exchange means having first and second refrigerant connections;

a refrigerant pressurizing device having a suction inlet and a high pressure outlet;

first refrigerant expansion means for expanding refrigerant from condenser to evaporator pressure connected between the second refrigerant connections on said first and second heat exchange means;

second refrigerant expansion means for expanding refrigerant from condenser to evaporator pressure connected to the second refrigerant connection on said third heat exchange means;

check valve means connecting said second refrigerant expansion means to the common points between said first refrigerant expansion means and each of said first and second heat exchange means so that refrigerant can flow from said alternate expansion means to said first and second heat exchange means but flow of refrigerant from said first and second heat exchange means to said third heat exchange means is prevented;

control valve means for selectively:

(a) connecting the first connection on said second heat exchange means to the suction inlet on said pressurizing device while connecting the high pressure outlet on said pressurizing device to the first connection on said first heat exchange means and while blocking the first connection on said third heat exchange means against refrigerant flow therethrough;

(b) connecting the first connection on said first heat exchange means to the suction inlet on said pressurizing device while connecting the high pressure outlet on said pressurizing device to the first connection on said third heat exchange means and while blocking the first connection on said second heat exchange means against refrigerant flow therethrough; and (c) connecting the first connection on said second heat exchange means to the suction inlet on said pressurizing device while connecting the high pressure outlet on said pressurizing device to the first connection on said third heat exchange means and while blocking the first connection on said first heat exchange means against refrigerant flow therethrough.

* * * * *